US006651729B1

(12) United States Patent
Marti et al.

(10) Patent No.: US 6,651,729 B1
(45) **Date of Patent: *Nov. 25, 2003**

(54) METHOD FOR OPERATING A STRIP-CASTING MACHINE USED FOR PRODUCING A METAL STRIP AND A CORRESPONDING STRIP-CASTING MACHINE

(75) Inventors: Heinrich Marti, Forch (CH); Jacques Barbé, Tarantaise (FR)

(73) Assignees: SMS Demag AG, Düsseldorf (DE); Main Management Inspiration AG, Hergiswil (CH)

( * ) Notice: Subject to any disclaimer, the term of this patent is extended or adjusted under 35 U.S.C. 154(b) by 0 days.

This patent is subject to a terminal disclaimer.

(21) Appl. No.: 10/088,834

(22) PCT Filed: Sep. 19, 2000

(86) PCT No.: PCT/EP00/09159

§ 371 (c)(1),
(2), (4) Date: Jun. 3, 2002

(87) PCT Pub. No.: WO01/23121

PCT Pub. Date: Apr. 5, 2001

(30) Foreign Application Priority Data

Sep. 24, 1999 (CH) ..... 1750/99

(51) Int. Cl.[7] ..... B22D 11/06; B22D 11/16

(52) U.S. Cl. ..... 164/452; 164/154.5; 164/428; 164/480

(58) Field of Search ..... 164/428, 480, 164/451, 452, 151.2, 154.2, 154.5

(56) References Cited

U.S. PATENT DOCUMENTS 5,184,668 A 2/1993 Fukase et al.
5,277,243 A 1/1994 Fukase et al.
6,354,365 B2 * 3/2002 Capotosti et al. ..... 164/480

FOREIGN PATENT DOCUMENTS

EP 0692330 1/1996

OTHER PUBLICATIONS

Patent Abstracts of Japan, vol. 016, No. 576 (M–1345), Dec. 16, 1992 & JP 04 224052 A (Nippon Steel Corp), Aug. 13, 1992.

Patent Abstracts of Japan, vol. 015, No. 310 (M–1144), Aug. 8, 1991 & JP 03 114633 A (Kawasaki Steel Corp), May 15, 1991.

Patent Abstracts of Japan, vol. 009, No. 132 (M–385), Jun. 7, 1985 & JP 60 0150515 A (Nippon Kokan KK), Jan. 25, 1985.

* cited by examiner

*Primary Examiner*—Kuang Y. Lin
(74) *Attorney, Agent, or Firm*—Friedrich Kueffner

(57) ABSTRACT

The invention relates to a strip-casting machine (20) for producing a metal strip. Said strip-casting machine consists of a pair of casting rolls (22, 24) arranged in side-by-side parallel relation of lateral sealing elements (25) that are provided with respective sealing plates (61) at both sides of the casting rolls (22, 24) and that adjoin the casting rolls. The contact pressure of the sealing plate (61) against the casting rolls (22, 24) and/or the frictional conditions between them can be measured. The sealing plates (61) at the front faces (22', 24') of the casting rolls (22, 24) are positioned at a distance of a few tenth of millimeters or so as to closely fit the front faces (22', 24') in the operational state, with our without contact pressure. The sealing plates are positioned in such a manner that also in the heated operational state the desired positions of the sealing plates relative to the front faces of the casting rolls are kept very precise.

14 Claims, 4 Drawing Sheets

METHOD FOR OPERATING A STRIP-CASTING MACHINE USED FOR PRODUCING A METAL STRIP AND A CORRESPONDING STRIP-CASTING MACHINE

BACKGROUND OF THE INVENTION

1. Field of the Invention

The invention pertains to a process for operating a strip-casting machine for the production of a metal strip, with two casting rolls set up next to each other to form a casting gap and with lateral sealing elements, which comprise sealing plates on each side of and in close proximity to the casting rolls, where the pressure which the sealing plate applies to the casting rolls and/or the frictional conditions between these components are measured, and where the sealing plates are positioned with respect to the end surfaces of the casting rolls in such a way that the nominal position of the sealing plates with respect to the end surfaces of the casting rolls can be maintained with a very high degree of precision, even at the high temperatures of the casting operation. The invention also pertains to a strip-casting machine for implementing the method.

2. Description of the Related Art

In a strip-casting machine of the type in question according to EP-A 0,714,716, the device for sealing the sides of the casting rolls consists of refractory sealing plates, which are pressed against the end surfaces of the two casting rolls on each side to prevent the steel melt which has been poured in between the casting rolls from escaping toward the sides. Thus a metal bath is formed instead, as in a conventional mold. As pressure is exerted on these sealing plates, they are subjected to frictional wear as a result of the rotation of the casting rolls, this wear being accompanied by large thermal load caused by the molten metal. One of the main problems in a casting machine of this type is therefore to ensure that the lateral sealing elements offer a reliable seal during the entire duration of the casting operation.

In the case of casting rolls with small diameters in the range of approximately 500–800 mm, the seals to be provided for the narrow sides are proportionately smaller. Because of the small volume of the metal bath, however, the surface of the molten bath is unsteady. In the case of the large casting rolls with diameters of, for example, approximately 1,500 mm, the surface of the molten bath is calmer because of its larger volume. Although this is advantageous, larger and more complicated lateral sealing elements become necessary. As a result of manufacturing and installation tolerances, irregular wear, and differences in the degrees to which casting rolls are heated as a result of deposits, it is possible that the sealing edges or sealing surfaces of the rolls are not precisely aligned with each other.

In EP-A 0,692,330, the contact conditions between the sealing walls and the casting rolls are detected by measuring the applied pressure and the frictional conditions, and after these values have been compared with the nominal values, at least one of the casting parameters is adjusted as required. So that such adjustment can be made, each of the sealing walls is held by an arrangement consisting of a main carrier, which can shift in the axial direction of the rolls, and a carrier which is guided horizontally on the main carrier. With this arrangement and with this system for controlling the sealing walls, however, optimal conditions for a long-lasting, satisfactory seal between these sealing walls and the casting rolls cannot be created, especially when work is being conducted with casting rolls with diameters of 1 meter or more.

There is also another document, namely, Patent Abstracts of Japan, Vol. 016, No. 576 (M-13 45), Dec. 16, 1992 & JP 4[1992]-224,052 A, which deals with the measurement of the friction between the end surfaces of the casting rolls of a strip-casting machine and with the appropriate adjustment of the applied pressure as a function of those measurements. To obtain the desired seal between the sealing plates and the end surfaces of the casting rolls, adjustable piston-cylinder units with a pressure control system for the pistons and with a distance sensor for the positioning of the pressure plates are provided. The seal of the end surfaces of the casting rolls by means of the sealing plates is no longer guaranteed by the control of the applied pressure, however, when the end surfaces of the casting rolls are no longer aligned with each other.

SUMMARY OF THE INVENTION

Proceeding from these known solutions, the present invention is based on the task of creating a method for operating a strip-casting machine of the general type indicated above, so that, by means of such a method, leak-proof conditions can be ensured at the lateral sealing elements throughout the entire duration of the casting operation even when casting rolls of the optimum diameter are used.

The task is accomplished according to the invention in that the positions of the sealing plates are measured in the direction of the casting roll axis, and in that at least one of the casting rolls can be adjusted, especially in the axial direction, so that the end surfaces of the casting rolls can be aligned with each other on the same plane as accurately as possible.

For a strip-casting machine, the task according to the invention is accomplished in that distance sensors are provided to measure the position of the end surfaces of the casting rolls in the axial direction of the rolls, and in that these distance sensors are in working connection with a device for axially displacing the casting rolls and for aligning the end surfaces of the casting rolls to be sealed with respect to each other.

With this strip-casting machine according to the invention, optimal lateral sealing of the casting rolls is achieved, which sealing function remains intact throughout the entire casting time even in the case of large casting rolls with diameters of more than 1 meter.

BRIEF DESCRIPTION OF THE DRAWING

An exemplary embodiment of the invention and additional advantages of same are explained in greater detail below on the basis of the drawing.

DETAILED DESCRIPTION OF THE PREFERRED EMBODIMENTS

Figure 1:
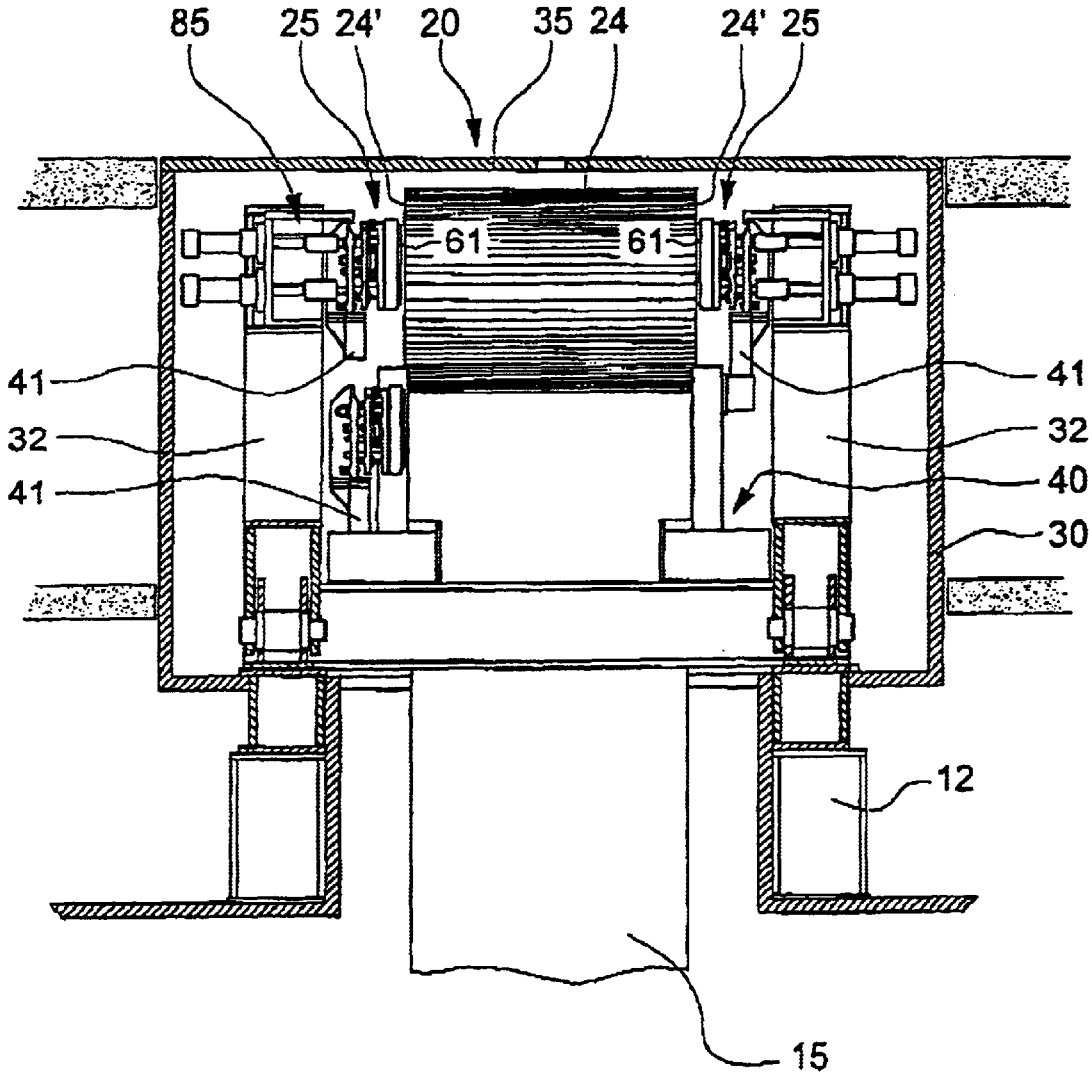
FIG. 1 shows a section through a strip-casting machine with the lateral sealing elements according to the invention.

FIG. 1 shows a strip-casting machine 20 for producing a metal strip 15, especially a steel strip, in a continuous casting process. This strip-casting machine 20 stands on a suggested steel structure 12 and is supplied with molten metal by a tundish vessel mounted above it, as known from conventional continuous-casting machines. It is advisable here for the discharge opening of the tundish vessel, through which the melt flows out, to have a stopper or the like which can seal the opening.

This strip-casting machine 20 consists primarily of two casting rolls 22, 24, which are set up essentially parallel to each other with their rotational axes approximately on a horizontal plane. A lateral sealing element 25 can be pressed against each of the two end surfaces, as a result of: which an enclosed space is created with an open casting gap at the bottom. The casting rolls 22, 24 are supported rotatably at each end on a standard 32, and each is driven in a controlled manner by a motor. The strip-casting machine 20 mounted on the suggested steel structure 12' or the like is enclosed in this case by a housing 30, so that the strip-casting operation can proceed under an inert gas, sealed off from the air. On the top of the housing 30, sliding doors 35 are provided so that the housing can be opened and closed.

Each of these lateral sealing elements 25 has a sealing plate 61, which can be pressed by a pressing means against the end surfaces of the casting rolls 22, 24 to produce a mechanical seal. These triangular sealing plates 61, made of a refractory material, cover approximately the upper part of the end surfaces 22', 24' of the casting rolls.

Figure 3:
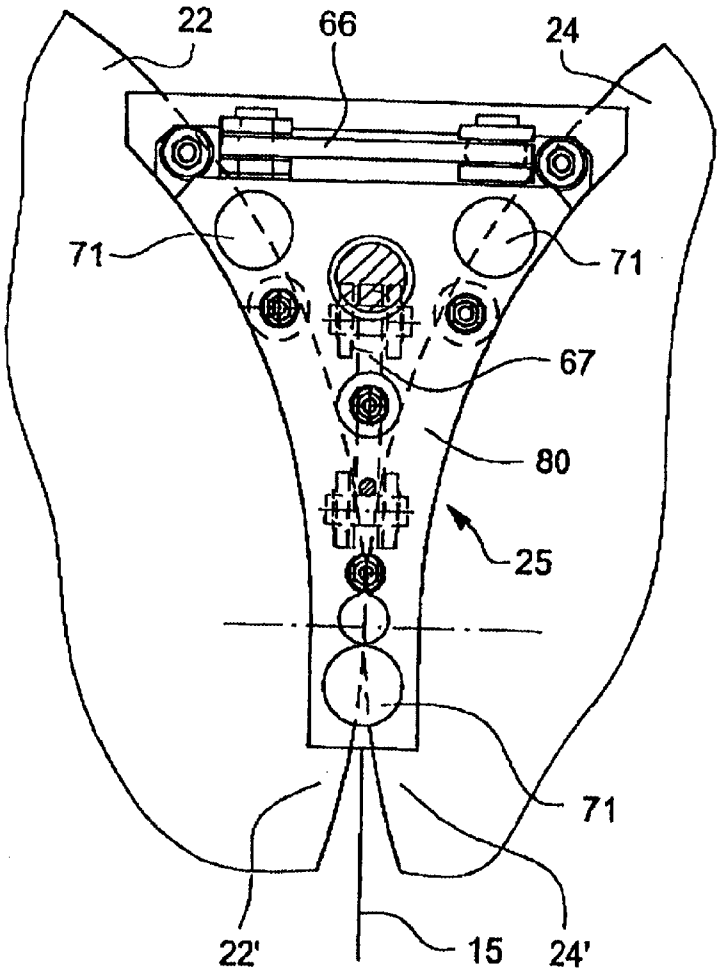
FIG. 3 shows a section through the lateral sealing element along line III—III of FIG. 2.
Figure 2:
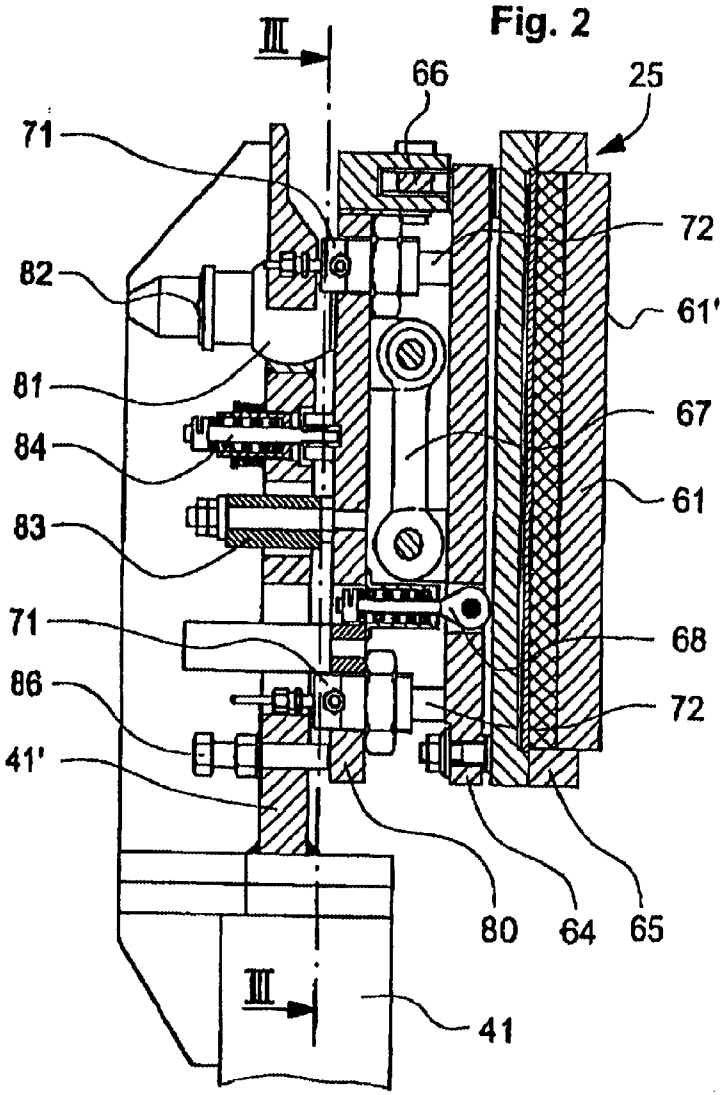
FIG. 2 shows a longitudinal section through a lateral sealing element according to FIG. 1.

According to FIGS. 2 and 3, each sealing plate 61 is mounted so that it can be shifted by the pressing means against the end surfaces 22', 24' of the casting rolls and is also supported in a floating manner by an articulation means—in the present case by a ball joint 81—so that the position can be kept constant and the sealing surface 61' can always be kept exactly parallel to the two end surfaces of the casting rolls, which lie on the same plane.

Three cylinders 71, each with a piston 72, which can be shifted in a direction approximately perpendicular to the sealing plate 61, are preferably provided, which exert an approximately constant, controllable pressure on the sealing plate 61 by way of a support frame 64, 65 in the manner of a three-point support, where each of these cylinders 71 advisably exerts its force at one of the three corner areas of the sealing plate 61, which, because of the arrangement of the casting rolls, is approximately triangular.

According to the invention, the sealing plates 61 are positioned to be less than a few tenths of a millimeter away from the end surfaces 22', 24' of the casting rolls 22, 24 or actually to rest against these end surfaces 22', 24', either with or without an applied pressure, so that, even at the high temperatures of the casting operation, the nominal position of the sealing plate in question with respect to the end surfaces of the casting rolls can be maintained with a very high degree of precision.

By positioning the sealing plates 61 according to the invention with respect to the end surfaces 22' of the casting rolls 22, 24 in this way, the two components can be adjusted optimally to each other, regardless of whether the sealing plates are positioned without contact with the casting rolls or whether they advantageously rest against them, with or without applied pressure. Thus an optimum sealing effect can be achieved, and in addition the wear of the sealing plates as well as that of the adjacent end surface areas of the casting rolls is reduced to a minimum.

The support frame 64, 65 holding the sealing plate 61 is supported on a butt plate 80 by way of articulated connections 66, 67. The butt plate is supported in turn in a floating manner on the carrier element 41 by the ball joint 81; the support frame 64, 65 is pressed at all times against the pistons 72 of the pressing means by an elastic connection, namely, an adjustable tension spring 68 with anchor, located between the frame and the butt plate 80. Each of the articulated connections is formed by an approximately horizontal articulated lever 66 and a vertical articulated lever 67, these articulated levers 66, 67 also being spherically supported at one end on the support frame 64 and at the other end on the butt plate 80, so that the sealing plate 61 can be moved both horizontally and vertically in a plane parallel to the butt plate 80. With this optimum support system for the sealing plate 61, it is possible permanently to exclude the possibility that the sealing plate can become jammed or locked even after the entire lateral sealing assembly has become hot.

A projecting centering pin 82, furthermore, is provided on the ball joint 81, by means of which the carrier element 41 can be centered with respect to the device 85. A cam 83 or the like makes it possible to center the lateral sealing element 25 vertically with respect to the carrier element 41. A flexible retaining element 84 is provided between the butt plate 80 and the top part 41' of the carrier element 41. A stop screw 86 on this top part 41' limits the range over which the plate 80 can swing.

FIG. 1 also clearly shows that the carrier element 41 holding the lateral sealing elements 25 is associated with a manipulator 40, by means of which the lateral sealing element in question can be moved laterally away from the casting rolls 22, 24 and returned. After the lateral sealing elements 25 have been brought laterally up into position next to the casting rolls 22, 24, they are centered by a device 85 mounted on the standard 32 of the casting rolls, and their cylinders 71 are connected to their respective drive elements. Conversely, after the device 85 has been disconnected, the lateral sealing elements 25 can be moved away by the manipulator for maintenance. The device 85 is mounted on the standard 32, but it could also be mounted on the manipulator.

Figure 4:
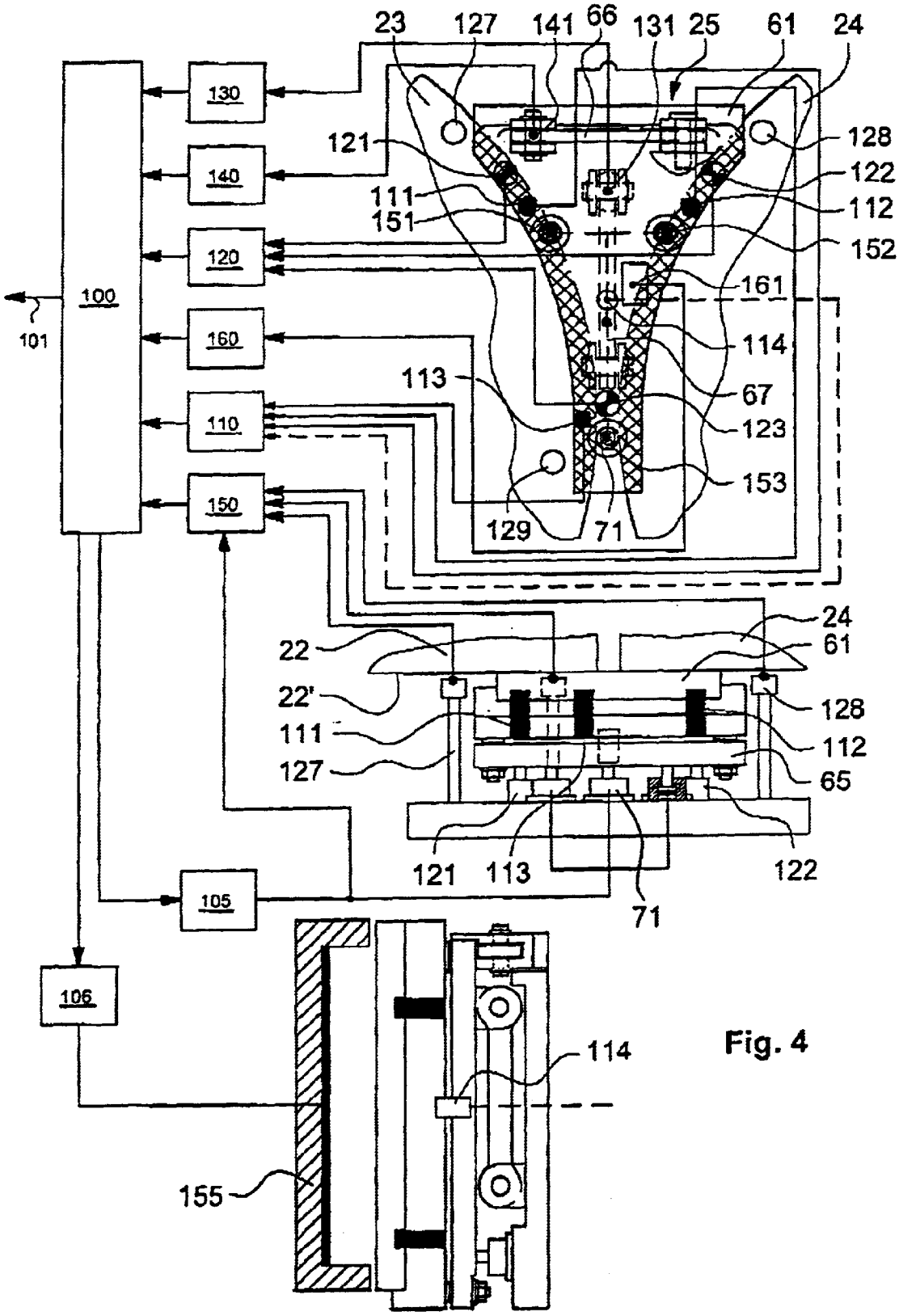
FIG. 4 shows a block diagram of a monitoring system for the lateral sealing elements, including a schematic view and a top view of the lateral sealing element.

A monitoring and control system according to FIG. 4 for these lateral sealing elements 25 makes it possible to adjust the sealing plates 61 with respect to the casting rolls 22, 24 in optimum fashion and also to monitor the system for problems, leaks, etc., both for the sake of prevention and for the sake of early detection in conjunction with an on-line error correction system, especially in regard to the sealing plate.

The strokes of the pistons of the cylinders 71 are measured by the measuring elements 151, 152, 153, and the positions of the end surfaces of the casting rolls are measured by the distance sensors 127, 128, 129. These measurements are transmitted to a receiver 150, and from there they are sent to an evaluation unit 100. The distance sensors 127, 128, 129 make it possible to detect the extent to which the casting rolls have worn down or expanded. On the basis of the stroke measurements of the pistons, it is possible to determine the position of the sealing plate 61 and, in cases where the plate is held under pressure, to determine the extent of its wear, which occurs in a controlled manner during the casting operation as a result of the rotating casting rolls and the resulting sliding friction. If the plate is wearing down too quickly, it is advantageous to lower the pressure being applied to it and vice versa.

This monitoring and control system also comprises three temperature probes 111, 112, 113, by means of which the temperatures at the contact points of the sealing plate 61 with the casting rolls 22, 24 in the end areas of the sealing plates 61 can be measured. These temperatures are then recorded by a receiver 110 and preferably compared with a nominal process in a central evaluation unit 100. As long as the temperatures at these contact points are below those of the melt, it can be assumed that operations are proceeding normally. But as soon as only one of the these temperatures rises disproportionately, it must be assumed that there is a leak between the sealing plate 61 and at least one of the casting rolls 22, 24.

The computer 100 then immediately issues a command via line 101 to close the stopper on the tundish vessel, and the flow of molten metal between the casting rolls is thus stopped.

Another temperature probe 114 is installed approximately at the center of the holding frame 65 of the sealing plate 61. The temperature measured here makes it possible to draw conclusions concerning the functionality of this holding frame 65 and especially concerning any deformations it may have undergone.

Three pressure cells 121, 122, 123 for the cylinders 71 are also provided in this monitoring system. In conjunction with an appropriate receiver 120, these pressures, which it is also advantageous to measure continuously, can be compared in an evaluation unit with a nominal trend of the cylinder pressures and thus used to regulate these pressures.

Strain gauges 131, 141 on the articulated levers 66, 67 are also provided within the scope of the invention, which, together with the receivers 130, 140, can be used to determine the change in the forces and thus in the frictional conditions between the sealing plate 61 and the casting rolls 22, 24. An increase in the coefficient of friction without any change in the applied pressure can indicate an increase in the wear of the sealing plate 61, whereas a decrease logically suggests a decrease in the perpendicular force component, on the basis of which a correction must be made in the form of an increase in the applied pressure.

By measuring the extension of the horizontal articulated lever 66, it is possible in particular to determine when the frictional force between the one casting roll 22 and the sealing plate 61 is different from that between the other casting roll and the sealing plate. When the frictional forces are balanced, the force at this articulated lever 66 is approximately zero. When these frictional forces are out of balance, the one or the other cylinder 71 can be actuated via the evaluation unit and a control valve 105, the pressure being thus adjusted to bring the horizontal force back to zero again.

In another variant, the sealing plates 61 of refractory material are pressed by the cylinders against the end surfaces 22', 24' and thus ground in before casting begins. By means of these strain gauges 131, 141, the frictional forces between the casting rolls and the sealing plate can be determined and adjusted to a defined value.

Another measuring instrument which can be used to advantage is a vibrometer 161, which can be installed between the sealing plate 61 and the holding frame 65 to measure the vibrations which occur during the casting operation. With this vibrometer 161 and the signal pickup 160, an operating problem can be quickly detected on the basis of a deviation between the actual vibrations and the nominal ones, such deviation occurring, for example, when there is a leak between one of the casting rolls and the casting plate, which necessarily changes the intensity of the vibrations produced between them. In the case a vibration slowly changing to, for example, a level approximately 50% below the normal vibration level, a correction of the applied pressure can bring the measurement back toward the nominal value. In principle, this vibration measurement leads to the improved utilization or to a longer life-span of the refractory sealing plate 61.

The values are stored in this monitoring and control system, and they can therefore be kept in long-term memory by the evaluation unit 100. Statistical values can be derived from them, which can be advantageously used on-line.

It is also conceivable that the automatic temperature control 110, 100 can be used to adjust the control 106 of the heating devices 155 (shown in FIG. 4) for the lateral sealing elements which are standing by to serve as replacements.

Figure 5:
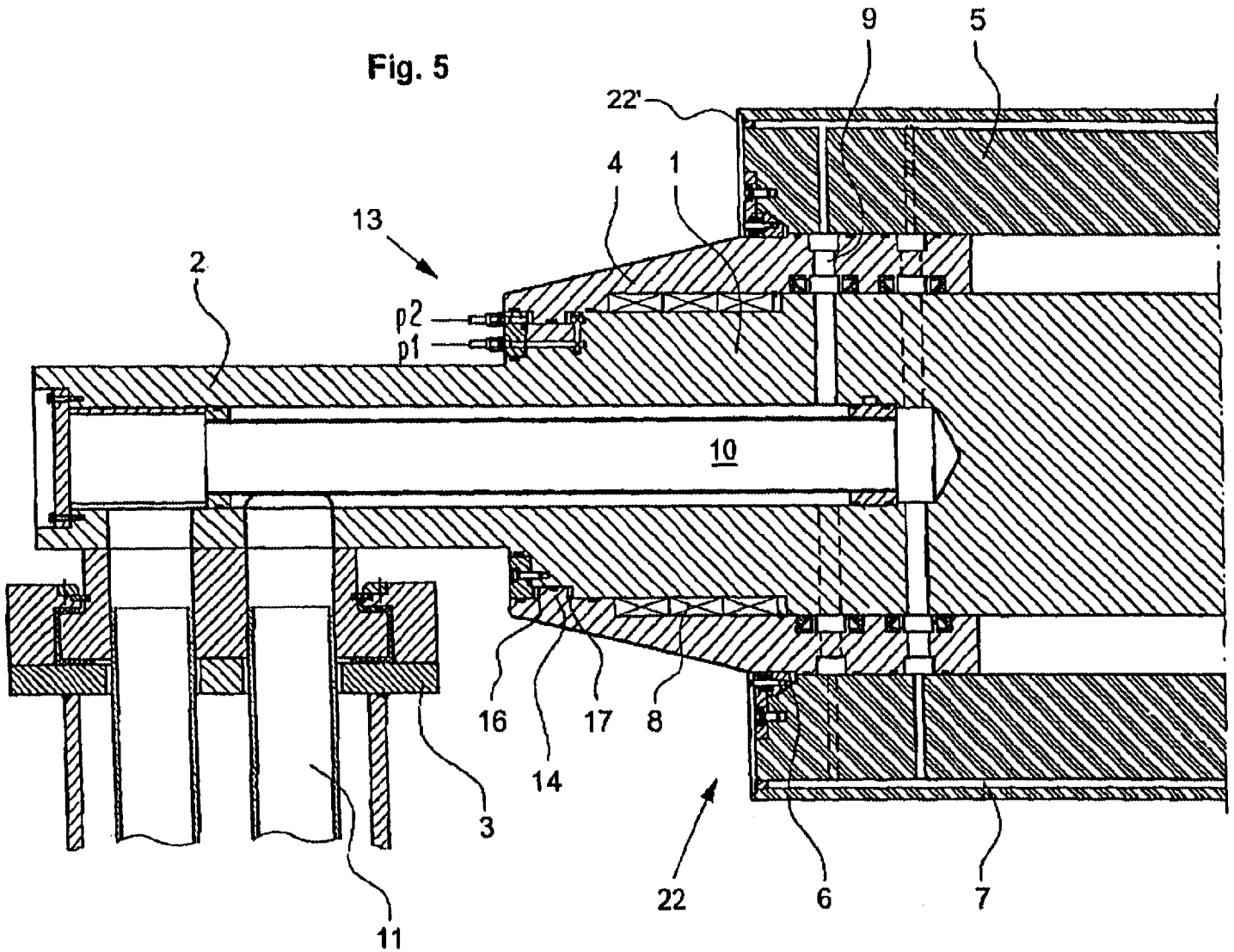
FIG. 5 shows a partial longitudinal section through a casting roll.

FIG. 5 shows a device for the axial displacement and alignment with respect to each other of the end surfaces 22' of the casting rolls 22 to be sealed. The casting roll 22 consists of a stationary axle 1 with axle journals 2, which are supported on a stand 3. The casting roll 22 comprises a ring-shaped support element 4, which is connected to the cylindrical jacket 5 by means of a wedge-type clamping device 6. The jacket 5 is provided around its circumference with axially oriented cooling bores 7, which are connected to additional bores 9, 10, 11 in the support element 4, in the axle 1, and in the stand 3, which supply and carry away a coolant. The jacket 5 and the support element 4 are driven by a motor/transmission device (not shown). So that the end surfaces 22' of the casting roll 22 can be aligned on the same plane with the end surfaces of the other casting roll (not shown), the jacket 5 is mounted on the stationary axle 1 with freedom to shift position together with the support element 4. The displacement is accomplished with a ring-shaped, double-acting piston-cylinder unit 13, which is connected to both the support element 4 and the axle 1 and is mounted at the end of the casting roll 22. A piston ring 14 on the support element 4 engages with clearance in a circumferential groove 16 in the axle 1, so that cylindrical chambers 17 are formed on both sides of the piston ring 14. Pressure can be built up in either of these chambers by a pressure medium via pressure lines p1 and p2. As a result of the difference in pressure between the chambers, the support element 4 and thus the end surface 22' of the casting roll 22 are shifted by a maximum value of, for example, 8 mm toward one side or the other.

In an automatic control process carried out by means of the evaluation unit 100, the positions of the casting rolls in the axial direction are measured by the distance sensors 127, 128, 129, and, if there is a deviation between the two casting rolls 22, 24, a correction is made so that the end surfaces 22', 24' lie on the same plane again on the one or on the other side of the casting rolls. This is accomplished by actuation of the piston-cylinder unit 13 by means of a valve (not shown).

If one of the casting rolls, by reason of wear, manufacturing tolerances, or some other reason, is shorter than the other roll by an amount of, for example, 0.3 mm, it is highly advantageous to position these casting rolls so that half of the total difference in length (e.g., 0.15 mm) between them is present on each side. This provides another effective means of avoiding leaks.

The invention has been sufficiently described on the basis of the exemplary embodiments described above, it could also be embodied in other variants. Thus, for example, a lateral sealing element 25 comprising a mechanical and/or a magnetic seal could be provided. To simplify the design of the monitoring system, it would be possible to provide only one or two measuring elements instead of three.

What is claimed is:

1. A method for operating a strip-casting machine for the production of a metal strip, the strip-casting machine including two casting rolls arranged next to one another to form a casting gap, and lateral sealing elements each having a sealing plate arranged on each side of and in close proximity to the casting rolls, the method comprising measuring a pressure applied by each sealing plate against the casting rolls and/or frictional conditions between the sealing plate and the casting rolls, positioning the sealing plates relative to end surfaces of the casting rolls such that a nominal position of the sealing plates relative to the end surfaces of the casting rolls is maintained precisely at high temperatures, measuring the positions of the end surfaces of the casting rolls in a direction of a casting roll axis, and adjusting at least one of the casting rolls in the axial direction for aligning the end surfaces relative to each other in a common plane.

2. The method according to claim 1, wherein, when one of the casting rolls is shorter than another of the casting rolls, positioning the casting rolls with respect to each other such that half of the difference in length is present on each side.

3. The method according to claim 2, wherein the difference in length is 0.3 mm and the positioning distance is 0.15 mm.

4. The method according to claim 1, further comprising measuring the positions of the sealing plates in the direction of the casting roll axis, and, in an automatic control process, comparing the positions of the sealing plates with nominal positions and moving the positions of the sealing plates as necessary into the nominal positions.

5. The method according to claim 1, comprising positioning the sealing plates relative to the end surfaces of the casting rolls such that each sealing plate is located less than a few tenths of a millimeter from the end surfaces or rests against the end surfaces, wherein positioning is effected with or without an applied pressure.

6. A strip-casting machine for the production of a metal strip, the machine comprising two casting rolls arranged next to one another to form a casting gap, and lateral sealing elements with sealing plates mounted on each side of and in close proximity to the casting rolls, comprising means for measuring a pressure applied by each sealing plate against the casting rolls and/or frictional conditions between the sealing plate and the casting rolls, means for positioning the sealing plates relative to end surfaces of the casting rolls, an evaluation unit for automatically regulating and controlling the lateral sealing elements during operation of the machine, distance sensors for measuring positions of the end surfaces of the casting rolls in an axial direction of the rolls, wherein the distance sensors are operatively connected to a device for axially displacing at least one of the casting rolls and for aligning the end surfaces of the casting rolls with respect to each other.

7. The strip-casting machine according to claim 6, wherein the positioning means for the sealing plates are configured to position the sealing plates relative to the end surfaces of the casting rolls such that the sealing plates are less than a few tenths of a millimeter away from the end surfaces or that the sealing plates rest against the end surfaces, with or without applying pressure.

8. The strip-casting machine according to claim 6, comprising at least one cylinder for shifting one of the sealing plates in the axial direction of the casting rolls, a measuring element for measuring a stroke of a piston of the cylinder and for transmitting a position of the piston to a receiver and from the receiver to the evaluation unit.

9. The strip-casting machine according to claim 8, comprising a pressure cell for the at least one cylinder for measuring the pressure of the sealing plate.

10. The strip-casting machine according to claim 8, wherein each lateral sealing element is attached to a carrier element and wherein each lateral sealing element is comprised of the sealing plate, a support frame holding the plate, the at least one cylinder acting on the plate, and a floating support for the at least one cylinder on the carrier element.

11. The strip-casting machine according to claim 10, wherein the support frame holding the sealing plate is supported on a butt plate by an approximately horizontal articulated lever and a vertical articulated lever, wherein the articulated levers are spherically supported at one end thereof on the support frame and at another end thereof on the butt plate.

12. The strip casting machine according to claim 11, wherein each of the articulated levers comprises a strain gauge for determining changes in forces and frictional conditions between the sealing plate and the casting rolls.

13. The strip-casting machine according to claim 6, comprising a plurality of temperature probes at contact points between the sealing plate and the casting rolls, whereby preventive monitoring and early detection of problems can be effected.

14. The strip-casting machine according to claim 6, comprising a vibrometer mounted on the sealing plate for measuring vibrations at the lateral sealing elements during operation.

* * * * *